US011191362B1

(12) United States Patent
Brinkley

(10) Patent No.: US 11,191,362 B1
(45) Date of Patent: Dec. 7, 2021

(54) HAMMOCK CHAIR SWING

(71) Applicant: BooneDOX, Inc., Thomasville, NC (US)

(72) Inventor: Chad Brinkley, Thomasville, NC (US)

(73) Assignee: BooneDOX, Inc., Thomasville, NC (US)

( * ) Notice: Subject to any disclaimer, the term of this patent is extended or adjusted under 35 U.S.C. 154(b) by 0 days.

(21) Appl. No.: 16/750,146

(22) Filed: Jan. 23, 2020

Related U.S. Application Data

(60) Provisional application No. 62/798,540, filed on Jan. 30, 2019.

(51) Int. Cl.

| | |
|---|---|
| ***A47C 4/02*** | (2006.01) |
| ***A47C 5/10*** | (2006.01) |
| ***A47C 17/64*** | (2006.01) |
| ***A45F 3/22*** | (2006.01) |
| ***A45F 3/26*** | (2006.01) |
| ***A47C 4/42*** | (2006.01) |
| ***A45F 3/24*** | (2006.01) |

(52) U.S. Cl.
CPC ..... *A47C 5/10* (2013.01); *A45F 3/22* (2013.01); *A45F 3/24* (2013.01); *A45F 3/26* (2013.01); *A47C 4/02* (2013.01); *A47C 4/022* (2013.01); *A47C 4/42* (2013.01); *A47C 17/645* (2013.01)

(58) Field of Classification Search
CPC .. A47C 4/28; A47C 4/286; A47C 5/10; A47C 17/645; A47C 4/02; A47C 4/022; A47C 4/42; A45F 3/24; A45F 3/22; A45F 3/26
USPC .... 297/16.1, 16.2, 17, 277; 5/114, 120, 122, 5/127, 129, 627; 472/118
See application file for complete search history.

(56) References Cited

U.S. PATENT DOCUMENTS

| | | | | | |
|---|---|---|---|---|---|
| 1,400,049 | A | * | 12/1921 | Goddard | A45F 3/22 5/128 |
| 2,646,577 | A | * | 7/1953 | Thayer | A47C 17/68 5/114 |
| 2,691,410 | A | * | 10/1954 | Boucher | A47C 4/286 297/45 |
| 3,315,281 | A | * | 4/1967 | Morris | A45F 3/24 5/120 |
| 3,321,780 | A | * | 5/1967 | Morris | A45F 3/24 5/122 |
| 5,320,404 | A | * | 6/1994 | Le Gal | A47C 9/105 297/16.2 |
| 5,499,857 | A | * | 3/1996 | Lynch, Jr. | A47C 4/286 297/16.2 |

(Continued)

FOREIGN PATENT DOCUMENTS

| | | | | | |
|---|---|---|---|---|---|
| DE | 2540693 | A | * | 1/1977 | A45F 3/24 |
| FR | 1443297 | A | * | 6/1966 | A47C 4/48 |

(Continued)

*Primary Examiner* — Robert Canfield
(74) *Attorney, Agent, or Firm* — MacCord Mason PLLC

(57) ABSTRACT

A seat system and assembly. A seat system may include a removable, repositionable elongated flexible body and a collapsible frame. The elongated flexible body may include an upper tapered portion and a lower tapered portion. The collapsible frame may have an elastic cord securing a plurality of interconnectable members. The result is a seat assembly to receive a weight of a user in a semi-reclined position and removable from the collapsible frame to a storage position.

16 Claims, 4 Drawing Sheets

(56) References Cited

U.S. PATENT DOCUMENTS

| | | | | |
|---|---|---|---|---|
| 5,729,845 | A * | 3/1998 | Hsu | A45F 3/24 5/120 |
| 6,666,507 | B1 * | 12/2003 | Ringgard | B62J 1/00 297/195.1 |
| 7,384,097 | B2 * | 6/2008 | Park | A47C 4/286 297/16.1 |
| 9,351,578 | B2 * | 5/2016 | Homans | A47C 4/02 |
| 9,861,180 | B1 * | 1/2018 | Jungling | A45F 3/24 |
| 2007/0252416 | A1 * | 11/2007 | Park | A47C 4/48 297/16.2 |
| 2009/0230736 | A1 * | 9/2009 | Homans | A47C 7/008 297/16.2 |
| 2016/0113402 | A1 * | 4/2016 | Lee | A47C 4/42 297/16.2 |

FOREIGN PATENT DOCUMENTS

| | | | | |
|---|---|---|---|---|
| FR | 3026625 | B1 * | 12/2016 | A47C 4/286 |
| GB | 191421562 | A * | 4/1915 | A45F 3/24 |
| GB | 458766 | A * | 12/1936 | A47C 4/286 |

* cited by examiner

HAMMOCK CHAIR SWING

This application claims the benefit of U.S. provisional application No. 62/798,540, filed Jan. 30, 2019, which is incorporated herein by reference in its entirety.

BACKGROUND

Field

The present disclosure relates generally to seats and, more particularly, to a collapsible hammock chair.

Background

Numerous lightweight, portable systems and devices enhance personal seating and allow for the reduction, or even elimination, of bulky, heavy, and unwanted seat limitations. However, conventional portable seating is often complex and carry common performance and comfort failures, including but not limited to, ease and reliability of assembly, disassembly, stowage, and the like. Further, conventional systems fail to provide aesthetically-pleasing and hybrid comfort.

Therefore, Applicant desires universal systems and assemblies of a hammock chair swing without the drawbacks presented by the traditional systems and methods.

SUMMARY

In accordance with the present inventions, a convenient, collapsible seat is provided to support a user above a surface. These inventions provide an improved seat system and assembly that is packable, efficient and safe for the user, particularly when used in both operating and transporting positions.

In one embodiment, a collapsible seat frame includes a pair of co-planar base members; a pair of co-planar distal members removably extending adjacent the base members and spaced apart from the base members at a first length; a pair of co-planar proximate members removably extending adjacent the base members and spaced apart from the base members at a second length greater than the first length; and an elastic cord interconnecting one of the distal member, the base member, and the proximate member.

In particular examples, the device includes a flexible body repositionable between the distal and proximate members. The flexible body may have a tapered upper portion secured over the pair of co-planar proximate members in an assembled position, and a tapered lower portion secured over the pair of co-planar distal members in an assembled position.

In certain examples, the pair of distal members may include a prescribed length shorter than a length of the pair of proximate members. The proximate member may include a first extension and a second extension separable from the first extension. The pair of distal members may be vertically offset about the pair of proximate members. The distal members may be aligned at an obtuse angle about the pair of horizontally positioned base members, and wherein the proximate members may be aligned at an obtuse angle about the pair horizontally positioned base members. The proximate end of the co-planar proximate members may be aligned at a height greater than a distal end of the co-planar distal members.

In one embodiment, a seat assembly includes a collapsible frame having an elastic cord securing a proximate removable member, a base removable member, and a distal removable member; and an elongated flexible body adapted to receive a weight of a user and removably aligned about the collapsible frame, and wherein the elastic cord protrudes through the proximate removable member, a base removable member, and a distal removable member in an assembled position and in a storage position.

In one example, the elastic cord protrudes through a footing between the proximate removable member and the base removable member. The footing may include a first opening adapted to detachably receive the proximate member and a second opening adapted to detachably receive the base member. The footing may include a first opening adapted to detachably receive the base member and a second opening adapted to detachably receive the distal member. The elastic cord may be a shock cord or the like. The elongated flexible body may include a pair of opposing tapered portions.

In another embodiment, a seat system includes an elongated flexible body having an upper tapered portion including a proximate cavity, a lower tapered portion including a distal cavity, and a middle extension portion spaced between the tapered portions; and a collapsible frame having a distal member end adapted to receive within the distal cavity, and a proximate member end adapted to receive within the proximate cavity.

In particular examples, an elastic cord protrudes through the proximate member and the distal member. The elastic cord may protrude through a first extension and a second extension of the proximate member. The system may include at least one footing that is generally secured by the elastic cord between the proximate member and the distal member. The distal member may be vertically offset about the proximate member. The proximate member may be at an obtuse angle about a horizontal surface plane in the assembled position.

In one embodiment, a seat system includes an elongated flexible body and a collapsible frame. The elongated flexible body may have an upper tapered portion including a proximate cavity, a lower tapered portion including a distal cavity, and a middle extension portion spaced between the tapered portions. The collapsible frame may have a distal member end to receive within the distal cavity, and a proximate member end to receive within the proximate cavity.

In some examples, the collapsible frame spatially separates the upper tapered portion about the lower tapered portion in an assembled position. The of the upper tapered portion may be greater than a length of the lower tapered portion in the assembled position, for instance with respect to a center point of the middle portion. The collapsible frame may align the proximate member end at a height above the distal member end in the assembled position. The upper tapered portion may include a closed end opposing the proximate cavity. Further, the system may include sidewalls that are generally adjacent the closed end. The lower tapered portion may include a closed end opposing the distal cavity. The system may include sidewalls that are generally adjacent the closed end.

In particular examples, the system may have an elastic cord that is generally protruding through, or otherwise connected thereto, the proximate member and the distal member. The elastic cord may protrude through a first extension and a second extension of the proximate member.

In certain examples, at least one footing is secured by the elastic cord between the proximate member and the distal member. Further, a central base member and a second footing may be secured by the elastic cord. The distal member may be aligned vertically offset about the proximate member. The distal member may be aligned at an obtuse angle about a horizontal surface plane in the assembled position. The proximate member may be aligned at an obtuse angle about a horizontal surface plane in the assembled position. The system may include a stopper at the distal member end, and further the system may include a stopper at the proximate member end.

In particular examples, the flexible body's central base portion may be a concave surface adapted to distribute a weight of a user across the flexible body. Further, the system may include a temporary storage to secure the flexible body and the collapsible frame in a folded, storage position.

In another embodiment, a seat assembly includes a collapsible frame having an elastic cord securing a plurality of interconnectable members of the collapsible frame; and an elongated flexible body adapted to receive a weight of a user and removably aligned about the collapsible frame.

In certain examples, the elastic cord protrudes through a proximate removable member, a base removable member, and a distal removable member. The elastic cord may protrude through a first extension and a second extension of the proximate member. The elastic cord may protrude through a footing between the proximate removable member and the base removable member. The footing may include a first opening adapted to detachably receive the proximate member and a second opening adapted to detachably receive the base member. The first opening may be aligned at an obtuse angle about the second opening. The proximate member may be slanted greater than perpendicular from the base member in an assembled position.

In particular examples, the elastic cord protrudes through a footing between the base removable member and the distal removable member. The footing may include a first opening to detachably receive the base member and a second opening to detachably receive the distal member. The first opening may be aligned at an obtuse angle about the second opening. The distal member may be slanted greater than perpendicular from the base member in an assembled position.

In some examples, the elastic cord may be a shock cord or the like. The elongated flexible body may include a pair of opposing tapered portions. The elongated flexible body may include a concave surface spaced between the pair of opposing tapered portions. The tapered portions may include a closed end and a receiving cavity.

In another embodiment, a seat comprises a pair of co-planar base members; a pair of co-planar distal members removably extending adjacent the base members and spaced apart from the base members at a first length; a pair of co-planar proximate members removably extending adjacent the base members and spaced apart from the base members at a second length greater than the first length; and a flexible body repositionable between the distal and proximate members.

In some examples, an elastic cord interconnects one of the distal member, the base member, and the proximate member in a proper maintained relationship. The pair of distal members may have a prescribed length shorter than a length of the pair of proximate members. The proximate member may include a first extension and a second extension separable from the first extension. The pair of distal members may be aligned vertically offset about the pair of proximate members. The distal members may be aligned at an obtuse angle about the pair of horizontally positioned base members. The proximate members may be aligned at an obtuse angle about the pair horizontally positioned base members.

In certain examples, a first footing may be between the proximate member and base member, and a second footing may be between the distal member and base member. The flexible body may have a tapered upper portion secured over the pair of co-planar proximate members. The flexible body may have a tapered lower portion secured over the pair of co-planar distal members. The proximate end of the co-planar proximate members may be aligned at a height greater than a distal end of the co-planar distal members.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
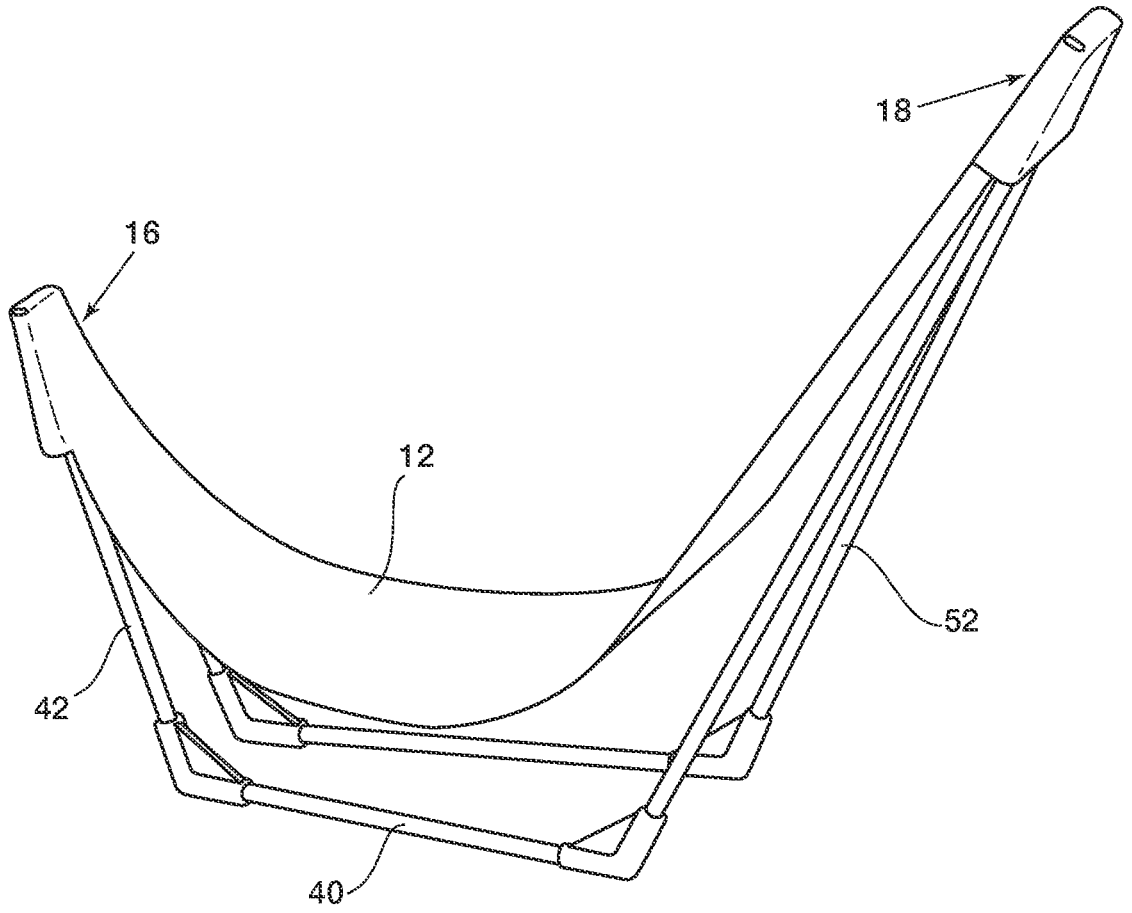
FIG. 1 is a side perspective view of an assembly according to one embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing embodiments of the disclosure and are not intended to limit the disclosure or any inventions thereto. As best seen in FIG. 1, the seat assembly 10 includes a collapsible frame supporting a removable, repositionable elongated flexible body 12 in an operating position. Typically, the collapsible frame includes base members 40 separating distal members 42 and proximate members 52 and maintained in an interconnected alignment.

As shown in FIG. 1, the elongated flexible body 12 is supported between the distal members 42 and proximate members 52 to receive a weight of a user in a semi-reclined, hammock-like position. In certain examples, the elongated flexible body 12 may move laterally, for instance perpendicular to base members and/or distal and proximate members. Applicant has unexpectantly discovered the arrangement of the distal members 42 and proximate members 52 relative to the elongated flexible body 12 provides a unique and improved user alignment as shown and described herein.

The elongated flexible body 12 may include opposing tapered portions between a receiving surface, for instance a concave surface 20. For example, the elongated flexible body 12 may have a tapered upper portion 18 generally aligned over end 58 (later illustrated in FIG. 3) of proximate members 52. Further, the elongated flexible body 12 may have a tapered lower portion 16 generally aligned over end 58 (later illustrated in FIG. 3) of distal member 42. In certain examples, the length of upper tapered portion 18 is greater than a length of lower tapered portion 16 with respect to a center point of a central, including offset middle, portion that supports a bulk of the user's weight in an operating position.

Figure 2:
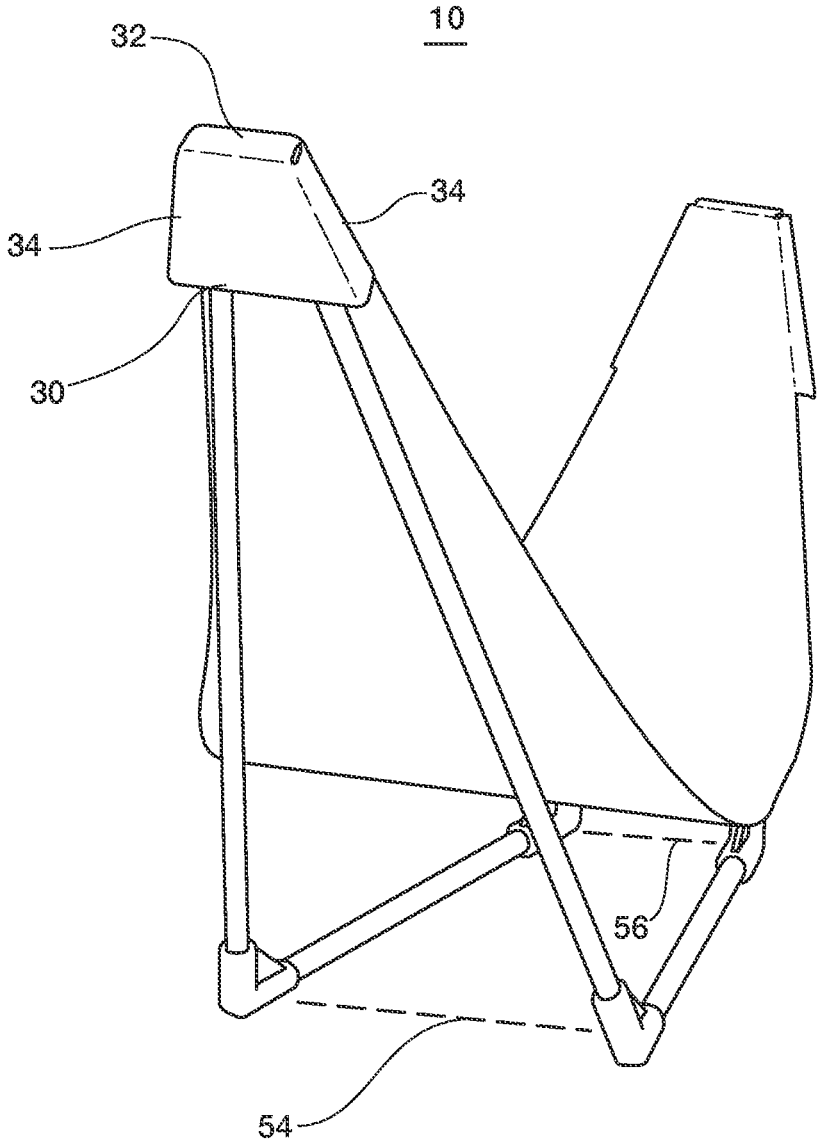
FIG. 2 is an end perspective view of an assembled embodiment according to FIG. 1.

In particular examples, the elongated flexible body 12 is affixed, including sewn or otherwise fastened, together to provide a cavity 30 in which to receive the respective distal members 42 and proximate members 52. As shown in FIG. 2, the lower portion 16 and upper portion 18 includes closed end 32 with opposing sides 34, thereby defining cavity 30. Those of ordinary skill in the art having the benefit of this disclosure will recognize additional cavity, support, and alignment features of the flexible body 12.

Typically, the collapsible frame includes an elastic cord 48, including, but not limited to, a shock cord, securing a plurality of interconnectable separable members. Generally, the pair of distal members 42 have a prescribed length that is shorter than a length of the pair of proximate members 52. The pair of distal members 42 are aligned vertically offset about the pair of proximate members 52 in the operating, assembled position. Thereby, the distal members 42 are aligned at an obtuse angle about the pair of horizontally-positioned base members 40 spanning along a surface, or the like. Similarly, the proximate members 52 are aligned at an obtuse angle about the pair horizontally positioned base members 40 spanning along a surface, or the like.

Figure 3:
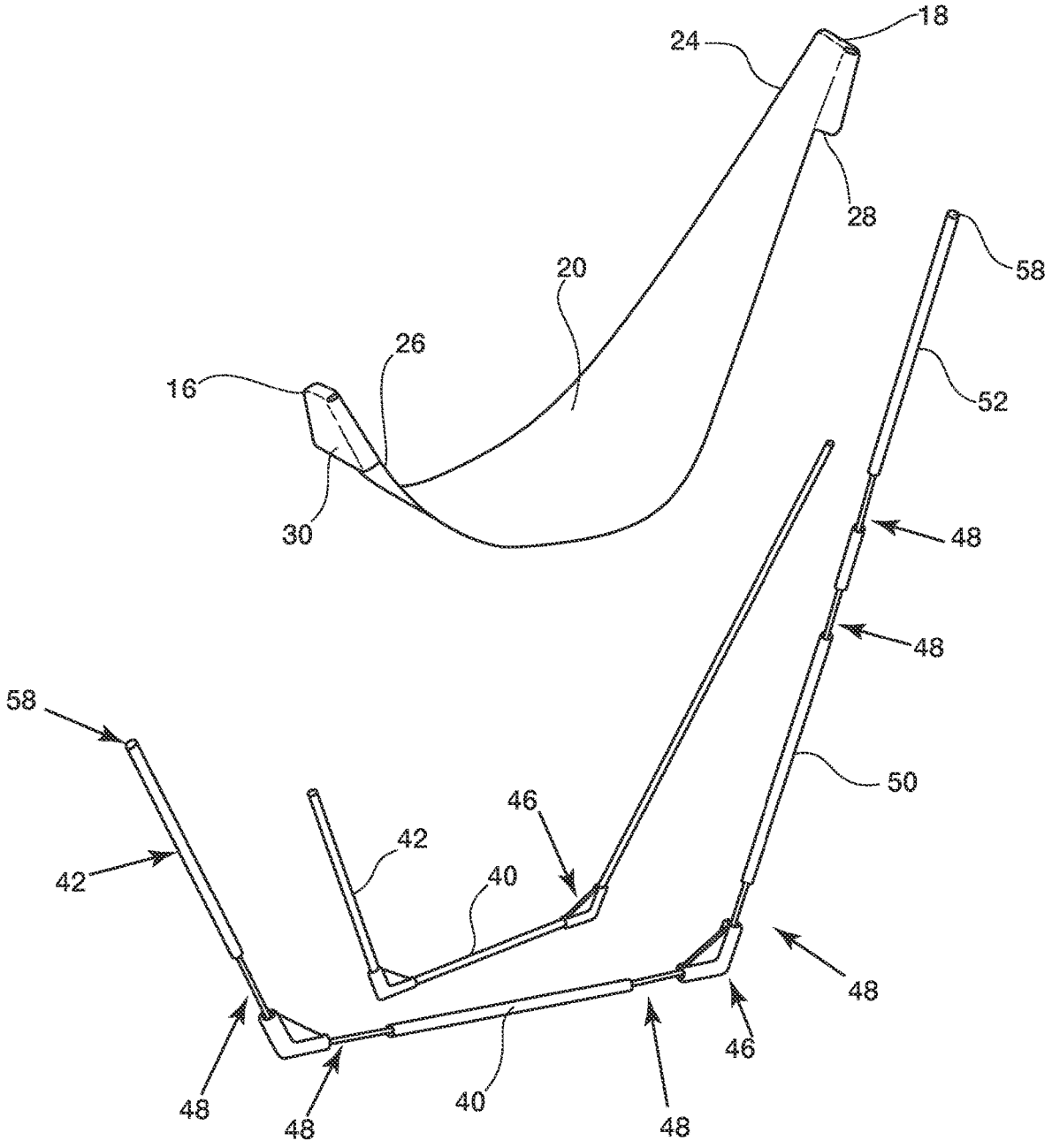
FIG. 3 is a partially exploded, perspective view of the embodiment of FIG. 1.

As shown in FIG. 3, the proximate member 52 may include distinct members, i.e. first extension 50 and second extension 52, aligned and maintained interconnectable together via elastic cord 48. As illustrated, the elastic cord 48 protrudes through base members 40 to at least one distal member 42. In particular examples, the elastic cord 48 protrudes through footings 46 between the associated members, including, but not limited to, between proximate member 52 and base members 40, as well as base members 40 and distal members 42. Footings 46 may include a variety of sizes, shapes, and arrangements to interconnect and support any of the members shown and described herein above a surface, including a semi-solid surface.

In certain examples, footing 46 includes a first opening to detachably receive proximate member 52 and a second opening to detachably receive base member 40. As illustrated, the first opening may be aligned at an obtuse angle about second opening to maintain the alignment shown and described herein. For instance, proximate member 52 may be slanted greater than perpendicular from base member 40 in an assembled position. Similarly, the opposing footing 46 may include a first opening to detachably receive base member 40 and a second opening to detachably receive distal member 42. The first opening may be aligned at an obtuse angle about the second opening, thereby distal member 42 is slanted greater than perpendicular from base member 40 in an assembled position.

Applicant has unexpectantly discovered the unanticipated advantages of maintaining the spatial relationship between the distal members 42 and proximate members 52 to support a user in the operating position. For instance, as shown in FIG. 2, the co-planar distal members extend adjacent from base members and spaced apart from base members at a first length 54, wherein substantially symmetrical co-planar proximate members extend adjacent from base members and are spaced apart from the first base members at a second length 56 that is generally less than first length 54 to maintain the spatial separation shown and described herein.

In one embodiment, a seat assembly 10 includes a collapsible frame having an elastic cord 48 securing a plurality of interconnectable members of collapsible frame; and an elongated flexible body 12 that, in certain embodiments, receives a weight of a single user, while being removably aligned about the collapsible frame.

In another embodiment, a seat includes a pair of co-planar base members 40; a pair of co-planar distal members 42 that are removably extending adjacent base members 40 and are spaced apart from base members 40 at a first length 54. The seat includes a pair of co-planar proximate members 52 that are removably extending adjacent base members 40 and are spaced apart from base members 40 at a second length 56 greater than first length 54. Further, the seat includes a flexible body 12 that is removable and repositionable between distal members 42 and proximate members 52 to provide the reclined positioning shown and described herein.

Figure 4:
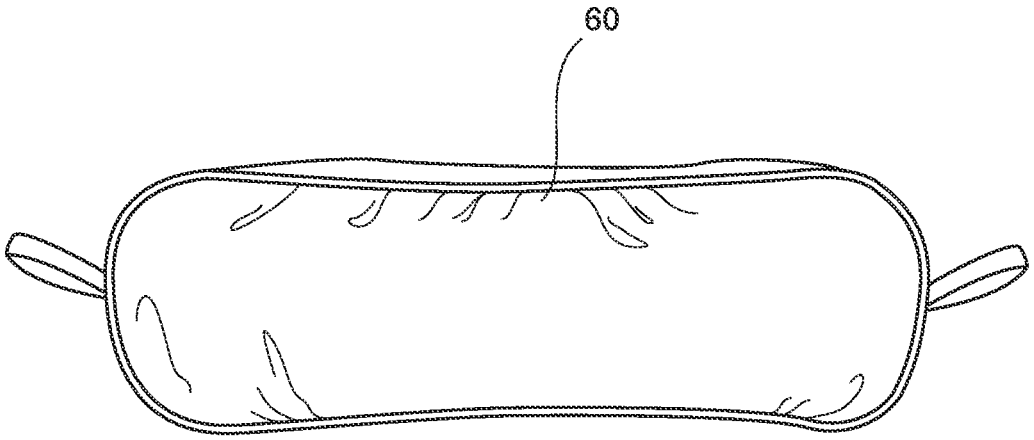
FIG. 4 is a front view of a storage assembly securing the embodiment in FIG. 1.

FIG. 4 introduces a temporary storage 60 to secure flexible body 12 and collapsible frame members in a folded, storage position. Those of ordinary skill in the art having the benefit of this disclosure will recognize additional storage features.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What is claimed is:

1. A collapsible seat frame comprising:
   a. a pair of co-planar base members;
   b. a pair of co-planar distal members removably extending adjacent said base members and offset from said base members at a first length;
   c. a pair of co-planar proximate members removably extending adjacent said base members and offset from said base members at a second length;
   d. an elastic cord interconnecting one said distal member, one said base member, and one said proximate member; and
   e. a footing having a first opening adapted to detachably receive one of said base members and a second opening adapted to detachably receive one of said distal members.

2. The collapsible seat frame of claim 1, including an elongated body repositionable between said distal and proximate members.

3. The collapsible seat frame of claim 2, wherein said elongated body having a tapered upper portion secured over said pair of co-planar proximate members in an assembled position, and a tapered lower portion secured over said pair of co-planar distal members in an assembled position.

4. The collapsible seat frame of claim 1, wherein said pair of distal members having a prescribed length shorter than a length of said pair of proximate members.

5. The collapsible seat frame of claim 1, wherein said pair of distal members aligned vertically offset about said pair of proximate members.

6. The collapsible seat frame of claim 1, wherein said distal members aligned at an obtuse angle about said pair of horizontally positioned base members, and wherein said proximate members aligned at an obtuse angle about said pair of horizontally positioned base members.

7. The collapsible seat frame of claim 1, wherein a proximate end of said co-planar proximate members aligned at a height greater than a distal end of said co-planar distal members.

8. A seat assembly comprising:

a. a collapsible frame having an elastic cord securing a proximate removable member, a base removable member, and a distal removable member; and b. an elongated body adapted to receive a weight of a user and removably aligned about said collapsible frame, and wherein said elastic cord protrudes through said proximate removable member, a base removable member, and a distal removable member in an assembled position and in a storage position, and wherein said elastic cord protrudes through a footing between said proximate removable member and said base removable member.

9. The assembly of claim 8, wherein said footing includes a first opening adapted to detachably receive said proximate member and a second opening adapted to detachably receive said base member.

10. The assembly of claim 8, including a footing having a first opening adapted to detachably receive said base member and a second opening adapted to detachably receive said distal member.

11. The assembly of claim 8, wherein said elastic cord comprises a shock cord.

12. The assembly of claim 8, wherein said elongated body includes a pair of opposing tapered portions.

13. A seat system comprising:

a. an elongated body having:

i. an upper tapered portion including a proximate cavity, ii. a lower tapered portion including a distal cavity, and iii. a middle extension portion spaced between said tapered portions; and b. a collapsible frame having a distal member end adapted to receive within said distal cavity, and a proximate member end adapted to receive within said proximate cavity;

c. an elastic cord protruding through said proximate member and said distal member; and d. at least one footing securely aligned by said elastic cord between said proximate member and said distal member.

14. The system of claim 13, wherein said elastic cord protrudes through a first extension and a second extension of said proximate member.

15. The system of claim 13, wherein said distal member aligned vertically offset about said proximate member.

16. The system of claim 13, wherein said proximate member aligned at an obtuse angle about a horizontal surface plane in said assembled position.

* * * * *